US011098639B2

(12) United States Patent
Vallee

(10) Patent No.: US 11,098,639 B2
(45) Date of Patent: Aug. 24, 2021

(54) FLAT TUBE FOR A CHARGE AIR COOLER AND CORRESPONDING CHARGE AIR COOLER

(71) Applicant: Valeo Systemes Thermiques, Le Mesnil Saint Denis (FR)

(72) Inventor: Nicolas Vallee, Bazancourt (FR)

(73) Assignee: Valeo Systemes Thermiques, Le Mesnil Saint-Denis (FR)

( * ) Notice: Subject to any disclaimer, the term of this patent is extended or adjusted under 35 U.S.C. 154(b) by 164 days.

(21) Appl. No.: 14/652,347

(22) PCT Filed: Dec. 18, 2013

(86) PCT No.: PCT/EP2013/077244

§ 371 (c)(1),
(2) Date: Jun. 15, 2015

(87) PCT Pub. No.: WO2014/096105

PCT Pub. Date: Jun. 26, 2014

(65) Prior Publication Data

US 2015/0322846 A1 Nov. 12, 2015

(30) Foreign Application Priority Data

Dec. 18, 2012 (FR) ..... 1262265

(51) Int. Cl.
*F02B 29/04* (2006.01)
*F28F 19/00* (2006.01)

(52) U.S. Cl.
CPC ..... *F02B 29/0462* (2013.01); *F28F 19/004* (2013.01); *F28F 2255/08* (2013.01)

(58) Field of Classification Search
CPC .. F02B 29/0462; F28F 19/004; F28F 2255/08
(Continued)

(56) References Cited

U.S. PATENT DOCUMENTS

2001/0010262 A1* 8/2001 Komoda ..... F28D 9/0043 165/167
2007/0122648 A1* 5/2007 Vieregge ..... B32B 15/016 428/654

(Continued)

FOREIGN PATENT DOCUMENTS

DE 10 2005 059717 A1 7/2006
EP 1 120 622 A1 8/2001

(Continued)

OTHER PUBLICATIONS

International Search Report issued in corresponding PCT Application No. PCT/EP2013/077244 dated Apr. 14, 2014 (4 pages).

*Primary Examiner* — Lindsay M Low
*Assistant Examiner* — Omar Morales
(74) *Attorney, Agent, or Firm* — Osha Bergman Watanabe & Burton LLP

(57) ABSTRACT

Flat tube of a charge air heat exchanger, produced from at least one metal sheet that has been pressed to form an exchange plate, said pressing allowing a fluid inlet and a fluid outlet to be connected by a circuit through which a heat-transfer fluid circulates, said circuit comprising at least one metal insert placed within it and made from a material that creates a potential difference of 30 mV or more with the material of the flat tube.

10 Claims, 1 Drawing Sheet

(58) Field of Classification Search
USPC ..... 123/542
See application file for complete search history.

(56) References Cited

U.S. PATENT DOCUMENTS

| | | | | |
|---|---|---|---|---|
| 2008/0041571 | A1* | 2/2008 | Minami | B23K 1/0012 165/151 |
| 2008/0190403 | A1* | 8/2008 | Grunenwald | C23F 13/14 123/568.12 |
| 2010/0089546 | A1* | 4/2010 | Perez | B21D 53/08 165/41 |

FOREIGN PATENT DOCUMENTS

| | | | | |
|---|---|---|---|---|
| EP | 2253917 | A1 * | 11/2010 | F28D 1/0333 |
| FR | 2925663 | A1 * | 6/2009 | F02B 29/0462 |
| GB | 2 078 359 | A | 1/1982 | |
| WO | 2012/018536 | A2 | 2/2012 | |

* cited by examiner

FLAT TUBE FOR A CHARGE AIR COOLER AND CORRESPONDING CHARGE AIR COOLER

BACKGROUND

The invention relates to the field of heat exchangers and more particularly of charge air heat exchangers used in the automotive field.

It is a known practice in the field of motor vehicles to use heat exchangers comprising a stack of identical flat tubes through which a first fluid circulates. Each flat tube is generally formed of two sheet-metal plates that are pressed in order to form a dish in a predefined pattern, and arranged in such a way that their concavities face one another. The two plates are then joined together in a fluidtight manner, thus forming a flat tube through which the first fluid can circulate from a fluid inlet toward a fluid outlet, each one situated at one end of the flat tube and more generally each one situated on opposite sides of the plate.

The flat tubes are stacked on top of one another, with the fluid inlets of each flat tube being joined together to form an inlet riser. Likewise, the fluid outlets of each flat tube are joined together to form an outlet riser. Between each flat tube is left a space for the passage of a second fluid. Exchange of heat between the two fluids then takes place as the first fluid passes through the flat tubes and the second fluid passes between said flat tubes.

Such heat exchangers are commonly used as evaporators in a refrigerant circuit for air conditioning the interior of a motor vehicle, this refrigerant constituting the first fluid and the second fluid being atmospheric air or as a heater in a heat-transfer fluid circuit for heating the cabin of a motor vehicle, this heat transfer fluid constituting the first fluid, and the second fluid being atmospheric air.

Nevertheless, such exchangers may prove ill-suited to use in a charge air intake circuit in which the thermal parameters are quite special. Specifically, before entering the combustion cylinders, the compressed and heated intake air needs to be cooled sufficiently by means of a heat exchanger in order to reduce the risks of self ignition, this being something that a conventional heat exchanger is unable to achieve effectively. In general, for greater efficiency, this type of charge air exchanger uses by way of first fluid a liquid such as water for example in order to cool the second fluid which is the charge air.

The use of a liquid as first fluid has the disadvantage of reducing the durability of the exchanger which in particular is more liable to become damaged through corrosion.

Thus, one of the objects of the invention is to at least partially remedy the disadvantages of the prior art and propose an improved charge air heat exchanger.

SUMMARY OF DISCLOSURE

The present invention therefore relates to a flat tube of a charge air heat exchanger, produced from at least one metal sheet that has been pressed to form an exchange plate, said pressing allowing a fluid inlet and a fluid outlet to be connected by a circuit through which a heat-transfer fluid circulates, said circuit comprising at least one metal insert placed within it and made from a material that creates a potential difference of 30 mV or more with the material of the flat tube.

According to one aspect of the invention, the flat tube is formed by the assembly of two heat-exchange plates which have been produced from a pressed metal sheet and assembled with one another, the pressed sides of each exchange plate facing each other.

According to another aspect of the invention, the insert is made of a metal alloy containing proportionately 0.7 to 1.5% zinc.

According to another aspect of the invention, the at least one exchange plate is made of a 3000-series aluminum alloy and that the insert is made of a 6815 or 6807 aluminum alloy.

The invention also relates to a charge air heat exchanger comprising at least one flat tube as described hereinabove.

Further features and advantages of the invention will become more clearly apparent from reading the following description given by way of illustrative and non-limiting example.

DETAILED DESCRIPTION

In the various figures, identical elements bear similar references.

Figure 1:
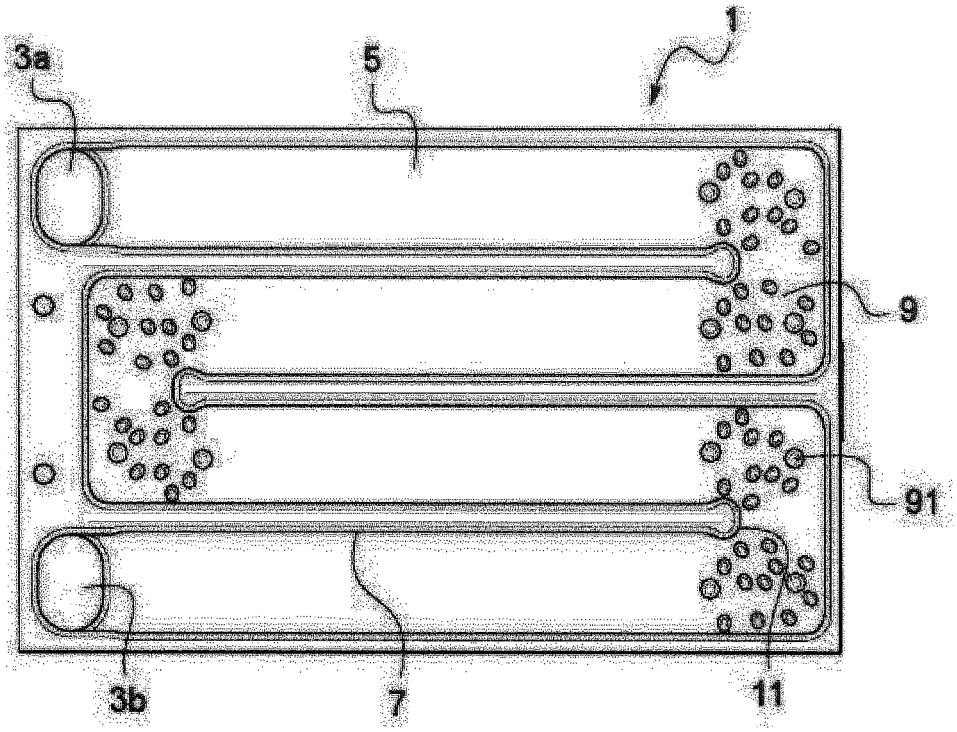
FIG. 1 is a schematic depiction of an exchange plate.

The exchange plate 1 for a flat tube 100 of a heat exchanger, depicted in FIG. 1, can be produced from a pressed metal sheet. It comprises a fluid inlet 3*a* and a fluid outlet 3*b*. The pressing of the exchange plate 1 forms a cavity with ribs 7 defining a flow circuit for fluid to flow between the fluid inlet 3*a* and the fluid outlet 3*b*.

The ribs 7 give the flow circuit a path for the circulation of a first heat-transfer fluid between the fluid inlet 3*a* and the fluid outlet 3*b*. This circulation path comprises at least two rectilinear passes 5 connected by a curved portion 9. This circulation path allows an increase in the length of the flow circuit and therefore increases the time for which the first heat-transfer fluid flows within it, thereby increasing the length of time for which there can be a transfer of heat with respect to a second fluid circulating on the opposite face of the exchange plate 1. To facilitate this flow of the first heat-transfer fluid, the ribs 7 may have rounded ends 11.

In the example set out in FIG. 1, the exchange plate 1 comprises four mutually parallel passes 5 and three curved portions 9 making the connection between said passes 5.

As FIG. 1 shows, the at least one curved portion 9 may have projections 91. These projections 91 may be formed as an integral part of the at least one heat exchange plate 1, for example being produced by pressing, or they may alternatively be elements attached and fixed inside the at least one curved portion 9 using any means known to those skilled in the art.

The flat tubes 100 are generally made up by assembling two exchange plates 1 with one another, the passes 5 and curves 9 of the circuits and the ribs 7 of each of the two exchange plates 1 facing one another, forming the circulation path of said flat tube 100. The exchange plates 1 are assembled in a fluidtight manner, for example using brazing, so as to avoid any leaks of heat-transfer fluid passing along the flat tube 100. Such flat tubes 100 are relatively slender; for example, the circulation path thereof may have a height from 1 mm to 3 mm.

Another way of embodying a flat tube 100 may be to assemble an exchange plate 1 with a flat plate resting on the periphery of the exchange plate 1 and on the ribs 7, covering the flow circuit.

Figure 2:
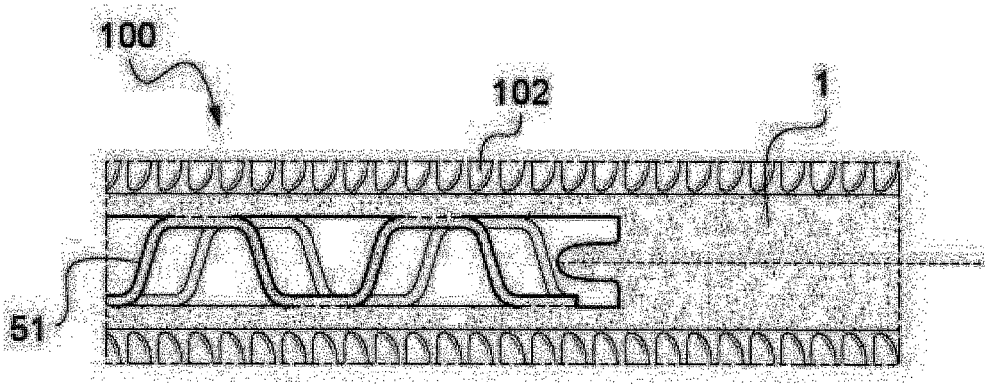
FIG. 2 is a schematic depiction in cross section of a flat tube according to the invention.

As shown by FIG. 2, inside the flat tube 100, the circuit comprises at least one insert 51 intended to perturb the circulation of the first heat-transfer fluid and create turbulence, and to increase the area of contact with the first heat-transfer fluid and therefore increase exchanges between said first fluid and the flat tube 100.

The at least one insert 51 is made from a metallic material that creates a potential difference of 30 mV or more with the material of the flat tube 100. This potential difference allows said insert to be a sacrificial anode which is corroded in preference over the material of the flat tube 100, the latter thereby gaining better ability over time to withstand corrosion.

In order for the insert 51 to be an effective sacrificial anode, said insert may be made from a metallic alloy proportionately containing 0.7 to 1.5% zinc.

It is thus possible to conceive of a flat tube 100 made from exchange plates 1 made of a 3000 series aluminum alloy, for example 3003 or 3916 aluminum alloy and comprising an insert made of 6815 or 6807 aluminum alloy, which contain zinc in optimum proportions.

The insert 51 may have a corrugated configuration at right angles to the direction of flow of the first heat-transfer fluid, the ends of each corrugation being in contact with the walls of the flat tube 100. The insert 51 may also, parallel to the direction in which the heat-transfer fluid circulates along the flat tube 100, have series of corrugated sections which are offset from one another at right angles to the direction in which the heat-transfer fluid circulates. The first heat-transfer fluid therefore passes between the corrugations of each section, increasing the area for contact and exchange between the fluid and the walls of the flat tube 100, and as it passes from one corrugated section to another, the first heat-transfer fluid is perturbed thereby allowing the temperature to be evened out and ensuring better efficiency of heat exchange with the flat tube 100.

Of course, said insert 51 may equally have other shapings allowing an increase in the area of contact and allowing the fluid to be evened out, such as a square wave form, zig zags or even louvers.

A heat exchanger with flat tube 100 also comprises a stack of flat tubes 100 joined together at their fluid inlet and outlet 3*a* and 3*b*, and each flat tube 100 being spaced away so as to allow a second fluid to pass between said flat tubes 100. The flat tubes 100 are joined together at the fluid inlet and outlet 3*a*, 3*b* to form a fluid inlet riser grouping together all the fluid inlets of all the flat tubes 100 and a fluid outlet riser grouping together all the fluid outlets of all the flat tubes 100. To facilitate the exchange of heat between the first heat-transfer fluid circulating through the flat tubes 100 and the second fluid passing between said flat tubes 100 it is also possible to add, on each side of the flat tube 100 perturbators 102 such as fins in the space between two flat tubes 100.

The use of attached components by way of inserts 51 in the passes 5 of the flat tubes 100 allows the latter to have a smooth wall which therefore makes attaching perturbators 102, for example by brazing, into the space between two flat tubes 100 easier.

Thus, it can be clearly seen that the flat tube 100, because of the presence of a metallic insert 51 made of a material that creates a potential difference of 30 mV or more with the material of the flat tube 100 and acts as a sacrificial anode, has better resistance to corrosion, notably corrosion by the first fluid, and therefore has a longer life.

What is claimed:

1. A flat tube of a charge air heat exchanger, the flat tube being produced from at least one metal sheet that has been pressed to form an exchange plate, said pressing allowing a fluid inlet and a fluid outlet to be connected by a circuit through which a heat-transfer fluid circulates, wherein said circuit comprises at least one metal insert placed within the circuit and made from a material that creates a potential difference greater than or equal to 30 mV with the material of the flat tube, wherein the pressing forms a cavity with ribs defining the circuit, wherein the at least one metal insert is parallel to a direction in which the heat-transfer fluid circulates along the flat tube, wherein the at least one metal insert have series of corrugated sections which are offset from one another at right angles to the direction in which the heat-transfer fluid circulates, wherein the circuit comprises at least two rectilinear passes connected by a curved portion, wherein the at least one metal insert is attached in the at least two rectilinear passes with ends of the at least one metal insert being in contact with walls of the flat tube inside the flat tube, wherein the at least one metal insert is made of a metal alloy containing proportionately 0.7 to 1.5% zinc, wherein only the curved portion connecting the at least two rectilinear portions comprises at least one projection produced by pressing, and wherein the at least one exchange plate is made of a 3000-series aluminum alloy and that the insert is made of a 6815 or 6807 aluminum alloy.

2. The flat tube as claimed in claim 1, wherein said flat tube is formed by the assembly of two exchange plates which have been produced from a pressed metal sheet and assembled with one another, the pressed sides of each exchange plate facing each other.

3. The flat tube of claim 1, wherein the at least one projection is formed as an integral part of the heat exchange plate.

4. The flat tube of claim 1, wherein the at least one projection is attached and fixed inside the curved portion.

5. The flat tube of claim 1, wherein the ribs have rounded ends.

6. A charge air heat exchanger comprising:

at least one flat tube produced from at least one metal sheet that has been pressed to form an exchange plate, said pressing allowing a fluid inlet and a fluid outlet to be connected by a circuit through which a heat-transfer fluid circulates, wherein said circuit comprises at least one metal insert placed within the circuit and made from a material that creates a potential difference greater than or equal to 30 mV with the material of the flat tube, wherein the pressing forms a cavity with ribs defining the circuit, wherein the at least one metal insert is parallel to a direction in which the heat-transfer fluid circulates along the flat tube, wherein the at least one metal insert have series of corrugated sections which are offset from one another at right angles to the direction in which the heat-transfer fluid circulates, wherein the circuit comprises at least two rectilinear passes connected by a curved portion, wherein the at least one metal insert is attached in the at least two rectilinear passes with ends of the at least one metal insert being in contact with walls of the flat tube inside the flat tube, wherein the at least one metal insert is made of a metal alloy containing proportionately 0.7 to 1.5% zinc, wherein only the curved portion connecting the at least two rectilinear portions comprises at least one projection produced by pressing, and wherein the at least one exchange plate is made of a 3000-series aluminum alloy and that the insert is made of a 6815 or 6807 aluminum alloy.

7. The charge air heat exchanger of claim 6, further comprising at least two flat tubes.

8. The charge air heat exchanger of claim 7, wherein the at least two flat tubes form a space to allow a second fluid to pass between the at least two flat tubes.

9. The charge air heat exchanger of claim 8, wherein the second fluid is air.

10. The charge air heat exchanger of claim 8, wherein each side of the at least one flat tube has perturbators in the space formed by the at least two flat tubes.

* * * * *